US011435076B2

(12) United States Patent
Alonso Lopez et al.

(10) Patent No.: US 11,435,076 B2
(45) Date of Patent: Sep. 6, 2022

(54) GAS BURNER AND DOMESTIC COOKING APPLIANCE

(71) Applicant: BSH Hausgeräte GmbH, Munich (DE)

(72) Inventors: Jose Manuel Alonso Lopez, Muriedas-Cantabria (ES); Javier Corral Ricalde, Muriedas (ES); Jose Salvador Ochoa Torres, El Astillero (ES); Carlos Pelayo Alonso, Villafufre (ES); Cristina Rueda Sanudo, Escobedo de Camargo (ES)

(73) Assignee: BSH Hausgeräte, Munich (DE)

( * ) Notice: Subject to any disclaimer, the term of this patent is extended or adjusted under 35 U.S.C. 154(b) by 376 days.

(21) Appl. No.: 16/310,827

(22) PCT Filed: Jun. 21, 2017

(86) PCT No.: PCT/IB2017/053687
§ 371 (c)(1),
(2) Date: Dec. 18, 2018

(87) PCT Pub. No.: WO2018/007892
PCT Pub. Date: Jan. 11, 2018

(65) Prior Publication Data

US 2019/0178491 A1 Jun. 13, 2019

(30) Foreign Application Priority Data

Jul. 4, 2016 (ES) ..... ES201630909

(51) Int. Cl.
*F23D 14/06* (2006.01)
*F23D 14/48* (2006.01)
(Continued)

(52) U.S. Cl.
CPC ..... *F23D 14/065* (2013.01); *F23D 14/06* (2013.01); *F23D 14/48* (2013.01); *F24C 3/122* (2013.01); *F23D 2900/14063* (2013.01)

(58) Field of Classification Search
CPC ..... F23D 14/06; F23D 14/065; F23D 14/48; F23D 2900/14063; F24C 3/122
See application file for complete search history.

(56) References Cited

U.S. PATENT DOCUMENTS 1,923,393 A * 8/1933 Pickup ..... F23D 14/64 239/543
3,382,860 A 5/1968 Cooper et al.
(Continued)

FOREIGN PATENT DOCUMENTS

CH 164036 A * 9/1933 ..... F23D 14/065
CH 177058 A * 5/1935 ..... F23D 14/065
(Continued)

OTHER PUBLICATIONS

International Search Report PCT/IB2017/053687 dated Aug. 24, 2017.
National Search Report ES P201630909 dated Dec. 28, 2016.

*Primary Examiner* — Jorge A Pereiro
*Assistant Examiner* — Logan P Jones
(74) *Attorney, Agent, or Firm* — Michael E. Tschupp; Andre Pallapies; Brandon G. Braun

(57) ABSTRACT

A gas burner for a household cooking appliance includes a first mixture-distribution chamber having a plurality of mixture-outlet openings, and a second mixture-distribution chamber separate from the first mixture-distribution chamber. The second mixture-distribution chamber is fluidically connected to the mixture-outlet openings of the first mixture-distribution chamber such that, when the gas burner is in operation, a combustion-gas/primary-air mixture is conducted out from the first mixture-distribution chamber and a
(Continued)

combustion-gas/primary-air mixture is conducted out from the second mixture-distribution chamber via the mixture-outlet openings for flame formation.

27 Claims, 9 Drawing Sheets

(51) Int. Cl.
*F24C 3/12* (2006.01)
*F24C 3/08* (2006.01)

(56) References Cited

U.S. PATENT DOCUMENTS 5,488,942 A * 2/1996 Maughan ..... F23D 14/06 126/39 E
6,132,205 A * 10/2000 Harneit ..... F23D 14/06 126/39 E
6,263,868 B1 7/2001 Koch et al.
6,332,460 B1 * 12/2001 Paesani ..... F23D 14/06 126/39 R
7,291,009 B2 * 11/2007 Kamal ..... F23D 14/06 126/39 E
2006/0051718 A1 * 3/2006 Kamal ..... F23D 14/06 431/354
2009/0145422 A1 * 6/2009 Paesani ..... F23D 14/74 126/39 E
2010/0092902 A1 4/2010 Paesani et al.
2014/0041650 A1 2/2014 Jeong et al.

FOREIGN PATENT DOCUMENTS

DE 29721269 U1 3/1998
DE 19907273 A1 8/2000
EP 2572141 B1 10/2014
FR 461634 A * 1/1914 ..... F23D 14/065
FR 484386 A * 10/1917 ..... F23D 14/065
GB 1262098 2/1972
GB 2503925 A 1/2014

* cited by examiner

GAS BURNER AND DOMESTIC COOKING APPLIANCE

CROSS-REFERENCES TO RELATED APPLICATIONS

This application is the U.S. National Stage of International Application No. PCT/IB2017/053687, filed Jun. 21, 2017, which designated the United States and has been published as International Publication No. WO 2018/007892 A1 and which claims the priority of Spanish Patent Application, Serial No. P20163-0909, filed Jul. 4, 2016, pursuant to 35 U.S.C. 119(a)-(d).

BACKGROUND OF THE INVENTION

The present invention relates to a gas burner for a household cooking appliance and a household cooking appliance with such a gas burner.

Gas burners for household cooking appliances comprise a burner lower part, in which a mixing chamber is provided, a nozzle holder, which has a gas nozzle for injecting combustion gas into the mixing chamber, and a burner cover placed on the burner lower part with mixture-outlet openings. On the injection of the combustion gas into the mixing chamber, primary air is drawn in at the side between the gas nozzle and a lower edge of the mixing chamber and mixed with the combustion gas. The combustion-gas/primary-air mixture is fed to a mixture-distribution chamber provided between the burner lower part and the burner cover and distributed uniformly by said chamber between the mixture-outlet openings for the purpose of flame formation.

DE 199 05 198 A1 describes a gas burner having two gas/air-mixture-supply chambers arranged one on top of the other which both produce a main flame, and preferably a warming flame, and an extremely low simmering flame through an in each case separate gas inlet attached to a burner head lower side with a gas/air mixture device for forming the gas/air mixture. An upper burner ring of the upper gas/air-mixture-supply chamber has on its outer diameter a gas-outlet openings, which generate the main flame, and preferably the warming flame, and a second burner ring of the lower gas/air-mixture-supply chamber under the upper burner ring has on its outer diameter a circumferential slot-shaped gas-outlet opening to support the burner head which generates the simmering flame, wherein the two outer diameters of the burner rings in the flame area are of the same size.

DE 199 07 273 A1 describes a gas burner with a simmer burner. The gas burner comprises a burner head and a burner cap and an injector assigned to the burner head with a vertical nozzle housing and a gas connection. The burner head is provided with a receiver for an additional simmer burner, which is positioned mainly on the outer edge, and a wall element, which is assigned to said area and forms a half-chamber, is mounted on the cap.

BRIEF SUMMARY OF THE INVENTION

Against this background, it is an object of the present invention to provide an improved gas burner.

Accordingly, the present invention suggests a gas burner for a household cooking appliance. The gas burner comprises a first mixture-distribution chamber having a plurality of mixture-outlet openings and a second mixture-distribution chamber that is separate from the first mixture-distribution chamber, wherein the second mixture-distribution chamber is fluidically connected to the mixture-outlet openings of the first mixture-distribution chamber such that, when the gas burner is in operation, both a combustion-gas/primary-air mixture from the first mixture-distribution chamber and a combustion-gas/primary-air mixture from the second mixture-distribution chamber can be conducted with the aid of the mixture-outlet openings out of the gas burner for the purpose of flame formation.

The gas burner is in particular a household appliance gas burner. The household appliance is in particular a gas stove or part of a gas stove. The combustion-gas/primary-air mixture is a mixture of combustion gas, for example natural gas, and primary air supplied to the gas burner. The combustion of the combustion gas requires air, in particular the aforementioned primary air and secondary air. In particular, the combustion gas is injected into a mixing chamber of the gas burner, wherein the injection of the combustion gas creates a Venturi effect and the primary air is drawn into the mixing chamber and mixed with the combustion gas. In contrast, to this end, the secondary air is the air required to combust the primary-air/combustion-gas mixture exiting the gas burner. Hereinafter, the combustion-gas/primary-air mixture can also be referred to as a gas mixture or mixture.

When the gas burner is in operation the combustion-gas/primary-air mixture exits through the mixture-outlet openings. Therefore, the mixture-outlet openings can also be referred to as combustion-gas/primary-air mixture outlet openings, gas-mixture-outlet openings or gas-outlet openings. The first mixture-distribution chamber is in particular configured to distribute the combustion-gas/primary-air mixture uniformly between the mixture-outlet openings. The first mixture-distribution chamber can also be referred to as a first combustion-gas/primary-air-mixture-distribution chamber or a first-gas-mixture-distribution chamber. The second mixture-distribution chamber can also be referred to as a second combustion-gas/primary-air-mixture-distribution chamber or a second gas-mixture-distribution chamber.

The first mixture-distribution chamber and the second mixture-distribution chamber are preferably arranged together in a burner housing of the gas burner. In particular, the first mixture-distribution chamber and the second mixture-distribution chamber are embodied as hollow spaces or cavities that are spatially separate from one another in the burner housing. The burner housing can have a plurality of individual parts. The separation of the first mixture-distribution chamber from the second mixture-distribution chamber should be understood to mean that a part of the burner housing of the gas burner is arranged between the first mixture-distribution chamber and the second mixture-distribution chamber. In other words, the first mixture-distribution chamber is spatially separate from the second mixture-distribution chamber. However, this does not exclude the possibility of a fluidic connection between the mixture-distribution chambers. However, the first mixture-distribution chamber can also be separate from the second mixture-distribution chamber such that there is no fluidic connection between the two mixture-distribution chambers. This means that, in this case, the combustion-gas/primary-air mixture from the first mixture-distribution chamber is unable to flow into the second mixture-distribution chamber and vice versa. Alternatively, the first mixture-distribution chamber and the second mixture-distribution chamber can be spatially separate from one another but still in fluidic connection with one another. For example, at least one connection, for example a bore or a channel, can be provided between the two mixture-distribution chambers that enables fluid exchange.

The number of mixture-outlet openings is optional. The mixture-outlet openings are preferably arranged uniformly distributed over a circumference of a burner cover of the burner housing of the gas burner. The mixture-outlet openings open directly into the first mixture-distribution chamber. This means that the first mixture-distribution chamber is connected directly, i.e. without interposed bores or channels, to the mixture-outlet openings. Fluidic connection of the second mixture-distribution chamber to the mixture-outlet openings of the first mixture-distribution chamber should be understood to mean that a combustion-gas/primary-air mixture accommodated in the second mixture-distribution chamber is able to flow from the second mixture-distribution chamber to the mixture-outlet openings. Herein, it is possible for the combustion-gas/primary-air mixture to flow from the second mixture-distribution chamber into the first mixture-distribution chamber whence it is distributed between the mixture-outlet openings. Alternatively or additionally, it is also possible for the second mixture-distribution chamber to be connected directly to the mixture-outlet openings via additional connecting channels. In this case, the combustion-gas/primary-air mixture flows directly from the second mixture-distribution chamber via the connecting channels into the mixture-outlet openings in order to exit the gas burner therethrough.

Hence, only one set, in particular one series or one burner ring, of mixture-outlet openings is provided for both mixture-distribution chambers. This means that a separate set of mixture-outlet openings is not provided for each mixture-distribution chamber. The different mixture-distribution chambers can be used to operate the gas burner in different operating modes. For example, in minimum-flame mode or simmer mode, the combustion-gas/primary-air mixture is only distributed from the second mixture-distribution chamber via the mixture-outlet openings. This results in a much simpler and more compact gas burner design compared to known gas burners. Furthermore, in minimum-flame mode, the performance of the gas burner is particularly good and precisely adjustable.

According to one embodiment, at least one connecting channel is provided that connects the second mixture-distribution chamber fluidically to the mixture-outlet openings of the first mixture-distribution chamber.

Preferably, at least one and in particular exactly one such connecting channel is assigned to each mixture-outlet opening. This means that preferably a plurality of connecting channels is provided that are arranged uniformly distributed over a circumference of the gas burner. The at least one connecting channel is provided in the burner housing. The second mixture-distribution chamber is in particular configured to distribute the combustion-gas/primary-air mixture uniformly between the connecting channels.

According to a further embodiment, the first mixture-distribution chamber is arranged above the second mixture-distribution chamber with respect to a direction of gravity.

The first mixture-distribution chamber and/or the second mixture-distribution chamber can each be embodied as annular. The mixture-distribution chambers can have an identical volume or different volumes. Alternatively, the first mixture-distribution chamber can also be arranged below the second mixture-distribution chamber with respect to the direction of gravity.

According to a further embodiment, the gas burner comprises a first mixing chamber for mixing combustion gas with primary air, wherein the first mixing chamber is in direct fluidic connection with the first mixture-distribution chamber, and a second mixing chamber separate from the first mixing chamber for mixing combustion gas with primary air, wherein the second mixing chamber is in direct fluidic connection with the second mixture-distribution chamber.

The mixing chambers are preferably embodied as cylinder-shaped. Each mixing chamber has a lower edge at which primary air is drawn into the respective mixing chamber. Direct fluidic connection of the respective mixing chamber to its assigned mixture-distribution chamber should be understood to mean that the first mixing chamber opens into the first mixture-distribution chamber or that the second mixing chamber opens into the second mixture-distribution chamber. This means that no additional lines, pipes, channels, bores or the like are provided between the first mixing chamber and the first mixture-distribution chamber or between the second mixing chamber and the second mixture-distribution chamber.

According to a further embodiment, a volume of the first mixing chamber is greater than a volume of the second mixing chamber.

For example, the volume of the first mixing chamber can be twice as high, three times as high, four times as high or five times as high as that of the second mixing chamber.

According to a further embodiment, the gas burner comprises a first gas nozzle for injecting combustion gas into the first mixing chamber and a second gas nozzle for injecting combustion gas into the second mixing chamber.

The gas nozzles are preferably each arranged centrally with respect to their assigned mixing chamber. The first gas nozzle is arranged completely outside the first mixing chamber and the second gas nozzle is arranged completely outside the second mixing chamber. This means that a spacing is provided between the respective gas nozzle and its assigned mixing chamber. The primary air is drawn in between the respective gas nozzle and the lower edge of the mixing chamber assigned to the respective gas nozzle. The combustion gas is mixed with the primary air in the mixing chambers. The premixed combustion-gas/primary-air mixture is then guided into the respective mixture-distribution chamber where it can be further mixed. This achieves a particularly homogeneous combustion gas/primary air mixture.

According to a further embodiment, the gas burner comprises an intermediate element, which is part of a burner housing of the gas burner and which separates the first mixture-distribution chamber from the second mixture-distribution chamber.

The intermediate element is preferably disk-shaped and has a central cylindrical base section. The intermediate element can be embodied as rotationally symmetrically to an axis symmetry or central axis of the gas burner.

According to a further embodiment, the at least one connecting channel is a bore provided in the intermediate element or a groove provided on an edge section of the intermediate element.

The cross section of the connecting channel can be circular, square, rectangular, triangular or any shape desired.

Preferably, a plurality of connecting channels is provided, wherein said channels are arranged distributed uniformly over a circumference of the intermediate element. The connecting channels preferably each open directly into their assigned mixture-outlet openings.

According to a further embodiment, the first mixing chamber is arranged at least partially in the intermediate element.

In particular the first mixing chamber is arranged in a base section of the intermediate element. The first mixing chamber is in particular assembled rotationally symmetrically to the central axis of the gas burner.

According to a further embodiment, the burner housing has a nozzle holder, a burner lower part comprising the intermediate element and a mixing chamber element and a burner cover placed on the burner lower part.

The nozzle holder, the intermediate element, the mixing chamber element and the burner cover are preferably each made of a magnesium alloy or an aluminum alloy. In particular, the individual parts of the burner housing can be die-cast components. As a result, the gas burner can be produced inexpensively in large numbers. The nozzle holder accommodates the gas nozzles. Herein, the gas nozzles can be positioned at the same height or different heights in the nozzle holder with respect to the direction of gravity. The burner lower part is accommodated at least partially in the nozzle holder. The nozzle holder is in particular positioned under a cover plate of the household cooking appliance. The burner lower part and the burner cover are in particular arranged above the cover plate. In particular, the cover plate can be firmly clamped between the burner lower part and the nozzle holder.

According to a further embodiment, the first mixing chamber is arranged at least partially in the mixing chamber element and the second mixing chamber is arranged completely therein.

In particular, the first mixing chamber is embodied both in the intermediate element and in the mixing chamber element. This means that the first mixing chamber extends from the mixing chamber element into the intermediate element. The second mixing chamber is arranged off-center with respect to the central axis of the gas burner. The second mixing chamber is in particular positioned next to the first mixing chamber.

According to a further embodiment, the first mixture-distribution chamber is provided between the intermediate element and the burner cover and/or the second mixture-distribution chamber is provided between the mixing chamber element and the intermediate element.

This means that the intermediate element separates the first mixture-distribution chamber spatially from the second mixture-distribution chamber.

According to a further embodiment, the mixture-outlet openings are provided on the burner cover.

The burner cover has a preferably circular and plate-shaped base section from which a bearing support section extends on the lower side. The bearing section lies on the burner lower part. The mixture-outlet openings are provided on the bearing section. The mixture-outlet openings can be embodied as grooves, slots, apertures or bores. The mixture-outlet openings are preferably embodied as slots. This enables the burner cover to be produced in a particularly simple manner.

According to a further embodiment, the gas burner comprises a plurality of connecting channels.

In particular, the number of connecting channels corresponds to the number of mixture-outlet openings. Preferably, a mixture-outlet opening is assigned to each connecting channel.

The invention also suggests a household cooking appliance, in particular a gas stove, with such a gas burner.

The household cooking appliance preferably has a plurality of such gas burners. A gas-regulator valve or gas-control valve can be assigned to each gas burner. The gas-control valve can be configured to regulate a combustion gas volume flow to the first gas nozzle and/or to the second gas nozzle in a stepless or stepped manner. Herein, depending upon the position of a control knob of the gas-control valve, combustion gas can be supplied to only the first gas nozzle, to only the second gas nozzle or to both gas nozzles simultaneously. The gas-control valve can also be a so-called step valve. The household cooking appliance furthermore has a common cover plate on which all the gas burners are mounted. The cover plate can, for example, be a steel sheet or a glass-ceramic plate. The household appliance can be a stand-alone appliance or a built-in appliance. The household appliance is preferably a household gas stove. For example, the household cooking appliance can have four such gas burners. The gas-control valve is clipped onto a main gas line of the household cooking appliance and fluidically connected via two gas-supply lines, namely one for the first gas nozzle and one for the second gas nozzle, to its assigned gas burner. Furthermore, an ignition device, which can be integrated in the gas-control valve, and an ignition element arranged directly on the gas burner, for example an ignition plug, can be assigned to each gas burner. Furthermore, each gas burner can also have a thermoelement for flame monitoring. The thermoelement is electrically connected to the gas-control valve of the respective gas burner.

Further possible implementations of the gas burner and/or the household cooking appliance also comprise combinations, even if they are not explicitly named, of features or embodiments that are described above or below. Herein, the person skilled in the art will also add individual aspects as improvements or extensions to the respective basic form of the gas burner and/or the household cooking appliance.

BRIEF DESCRIPTION OF THE DRAWINGS

Further advantageous embodiments and aspects of the gas burner and/or the household cooking appliance are the subject matter of the subclaims and the exemplary embodiments of the gas burner and/or the household cooking appliance described below. The gas burner and/or the household cooking appliance will now be described in more detail with reference to preferred embodiments and with reference to the attached figures.

DETAILED DESCRIPTION OF EXEMPLARY EMBODIMENTS OF THE PRESENT INVENTION

Figure 1:
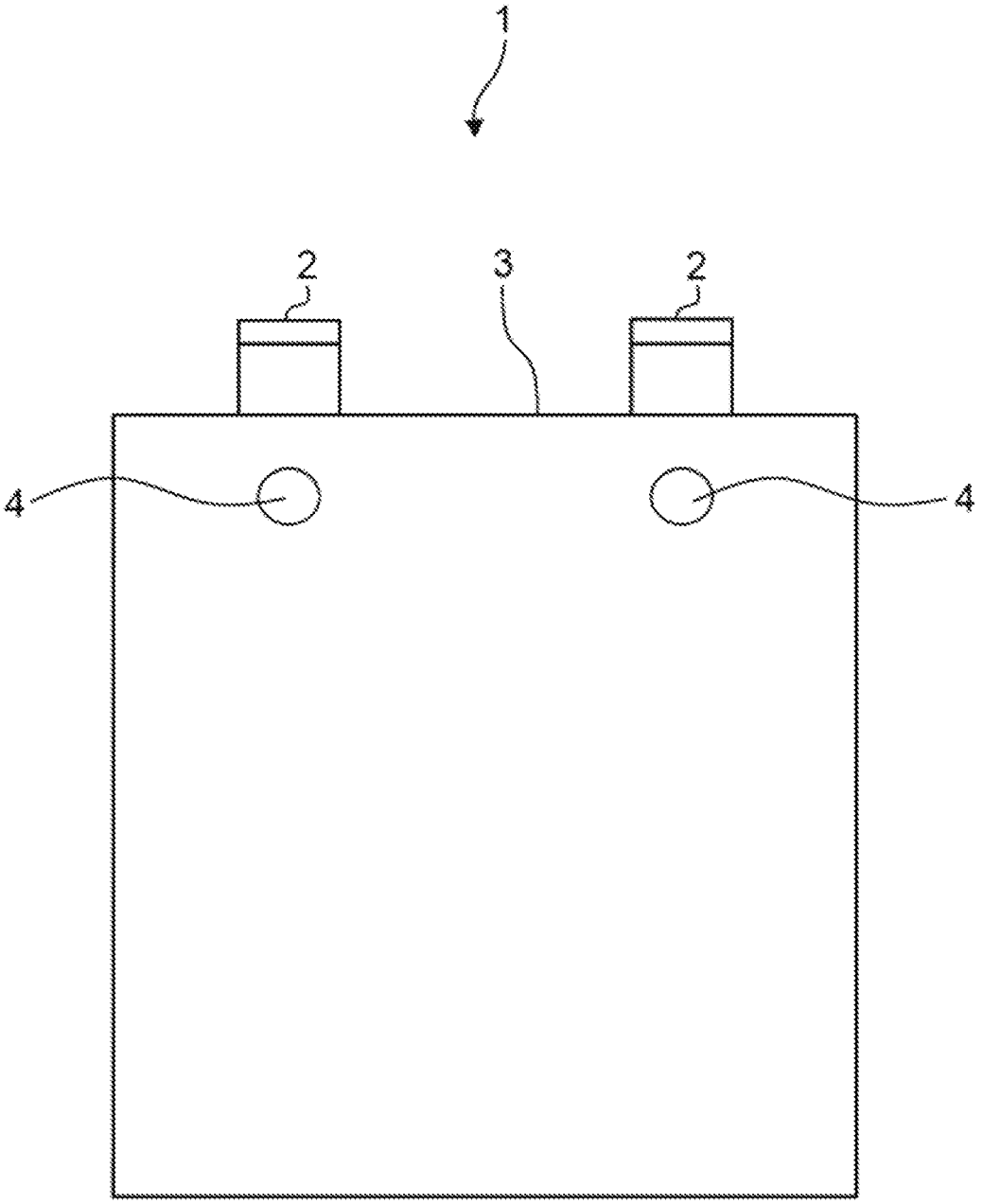
FIG. 1 shows a schematic view of an embodiment of a household appliance.

In the figures, the same reference characters denote elements that are the same or have similar functions, unless specified otherwise.

FIG. 1 shows a schematic view of an embodiment of a household cooking appliance 1. The household cooking appliance 1 is in particular a gas stove or household gas stove. The household cooking appliance 1 can be a built-in appliance or a standalone appliance. The household cooking appliance 1 comprises a plurality of gas burners 2. The gas burners 2 can also be referred to as household-appliance gas burners. The number of gas burners 2 is optional. For example, four gas burners 2 can be provided. The gas burners 2 are arranged on a common cooktop plate 3. For example, the gas burners 2 can be attached to the cooktop plate 3. The gas burners 2 can each have an annular circumferential heat protection, which is configured to protect the cooktop plate 3 from heat input from the waste heat from the gas burners 2.

The cooktop plate 3 can for example be a steel sheet or a glass-ceramic plate. Each gas burner 2 is assigned a gas-regulator valve or gas-control valve 4 which can be used to switch on, switch off and, in particular steplessly, adjust the combustion-gas flow supplied to the respective gas burner 2 as desired. Alternatively, the gas-control valves 4 can also be configured to regulate the combustion-gas flow supplied to the respective gas burner 2 in a stepped manner. This means that the gas-control valves 4 can be embodied as stepped gas-control valves or so-called step valves.

Figure 2:
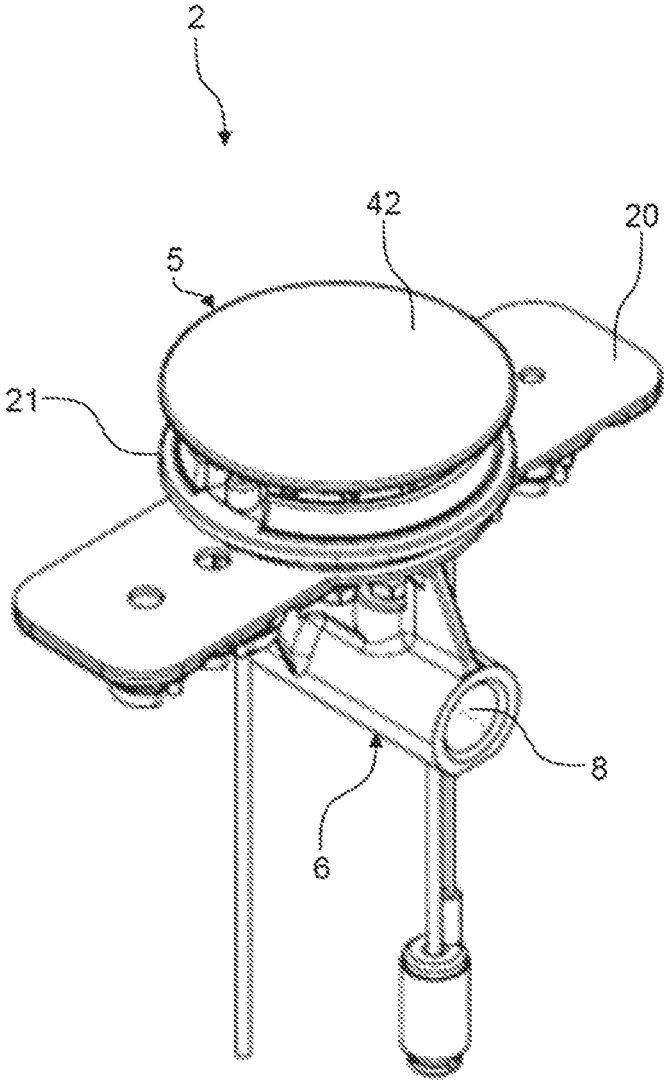
FIG. 2 shows a schematic perspective view of an embodiment of a gas burner for the household cooking appliance in FIG. 1.
Figure 3:
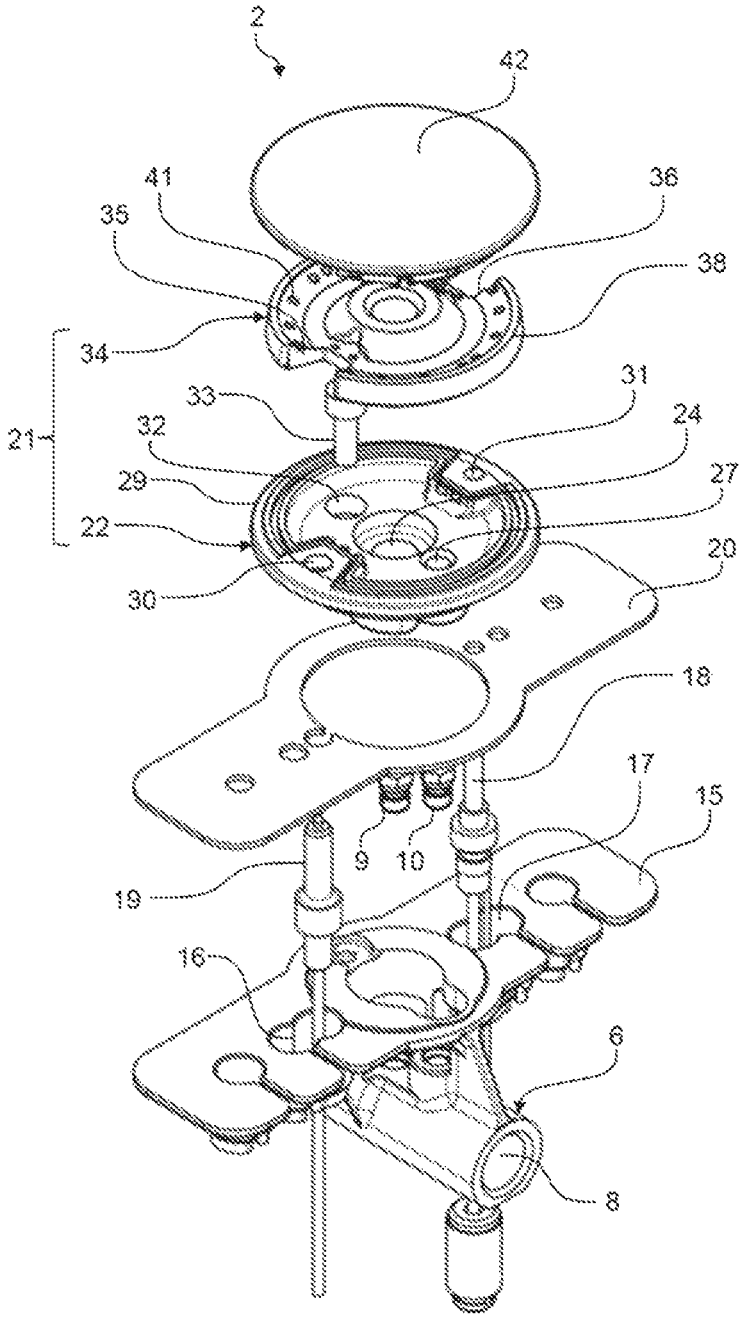
FIG. 3 shows a schematic exploded perspective view of the gas burner in FIG. 2.
Figure 4:
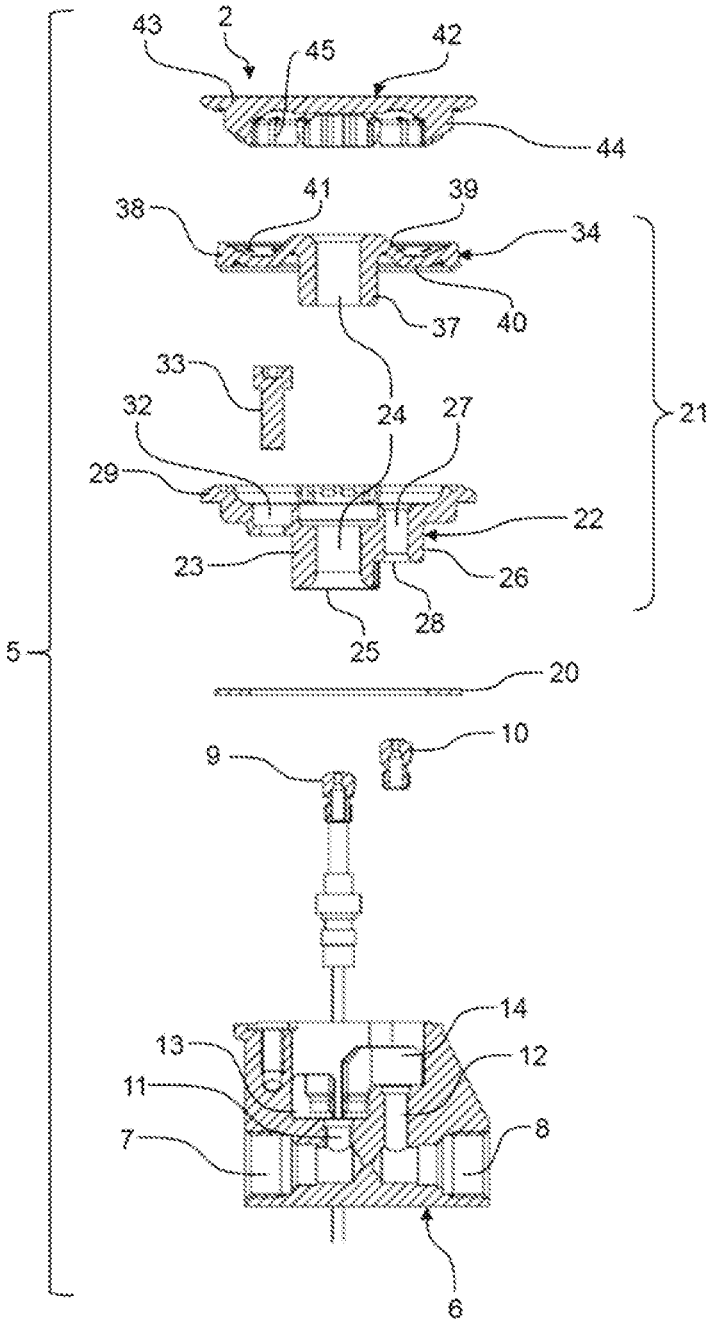
FIG. 4 shows a schematic sectional exploded view of the gas burner in FIG. 2.
Figure 5:
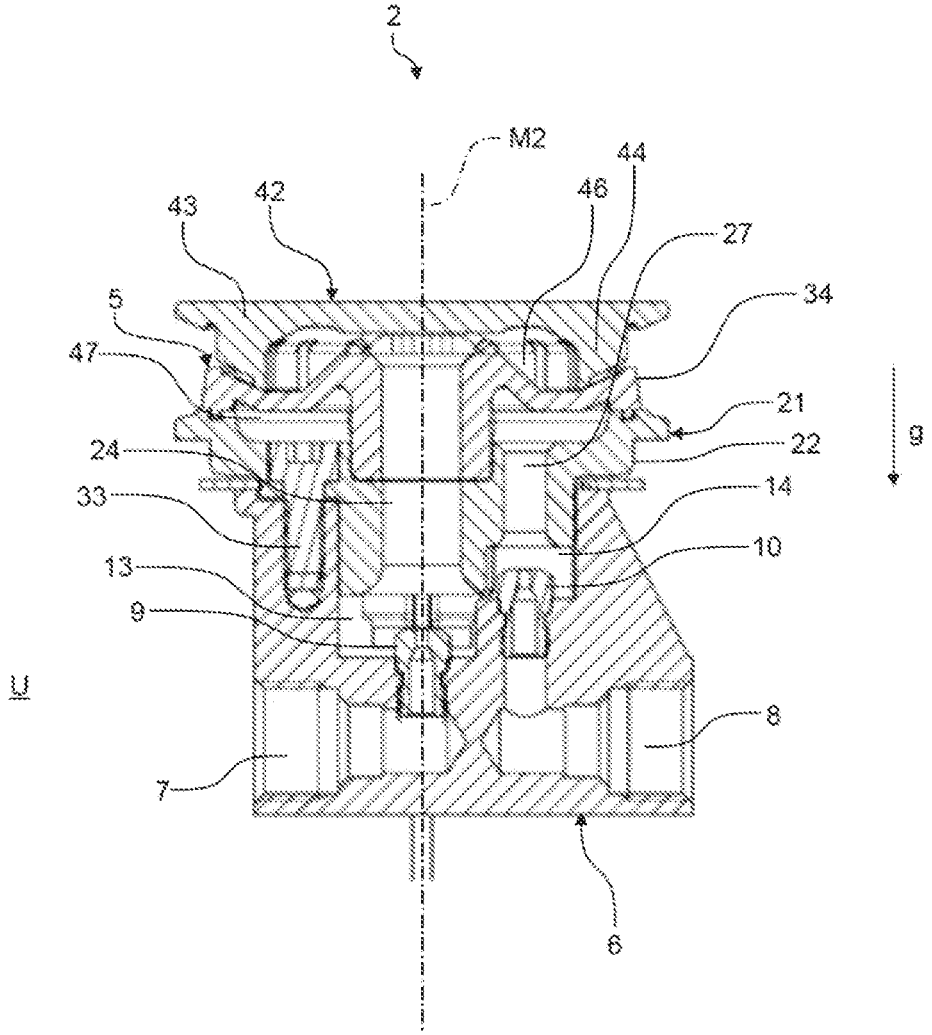
FIG. 5 shows a schematic sectional view of the gas burner in FIG. 2.

FIG. 2 shows a schematic perspective view of an embodiment of a gas burner 2 for the household cooking appliance 1 as shown in FIG. 1. FIG. 3 shows a schematic exploded perspective view of the gas burner 2. FIG. 4 shows a schematic sectional exploded view of the gas burner 2 and FIG. 5 shows a schematic sectional view of the gas burner 2. The following refers to FIGS. 2 to 5 simultaneously.

The gas burner 2 comprises a multipart burner housing 5. The burner housing 5 can for example be made of an aluminum alloy or a magnesium alloy. The burner housing 5 is preferably made of die-cast components, in particular aluminum die-cast components or magnesium die-cast components. The burner housing 5 comprises a nozzle holder 6, which is arranged below the cooktop plate 3. A first gas-supply line 7 and a second gas-supply line 8 are provided in the nozzle holder 6. The first gas-supply line 7 and the second gas-supply line 8 are not fluidically connected to one another. The first gas-supply line 7 is used to supply combustion gas to a first gas nozzle 9 accommodated in the nozzle holder 6. The second gas-supply line 8 is used to supply a combustion gas to a second gas nozzle 10 accommodated in the nozzle holder 6.

The gas-supply lines 7, 8 are each fluidically connected by means of a gas line, not shown, to a gas-control valve 4 assigned to the gas burner 2. The gas-control valve 4 is clipped onto a main gas line of the household cooking appliance 1. The gas-control valve 4 can be used to adjust a combustion-gas flow supplied to the respective gas-supply line 7, 8 in a stepless or stepped manner. The first gas nozzle 9 is accommodated in a first bore 11 provided in the nozzle holder 6. The first bore 11 is arranged perpendicular to the first gas-supply line 7 and opens into the first gas-supply line 7. The first bore 11 can have an internal thread into which an external thread of the first gas nozzle 9 is screwed. This means that the first gas nozzle 9 is screwed into the first bore 11. The second gas nozzle 10 is accommodated in a second bore 12 which is also provided in the nozzle holder 6. The second bore 12 is arranged perpendicular to the second gas-supply line 8 and opens thereinto. The second bore 12 can have an internal thread into which a corresponding external thread of the second gas nozzle 10 is screwed. This means that the second gas nozzle 10 is screwed into the second bore 12.

Herein, the bores 11, 12 can be arranged parallel to an axis of symmetry or central axis M2 of the burner housing 5 or the gas burner 2 arranged. As FIG. 5 shows, the first gas nozzle 9 is positioned rotationally symmetrically to the central axis M2. The second gas nozzle 10 is positioned off-center, i.e. next to the first gas nozzle 9. The first gas nozzle 9 is positioned below the second gas nozzle 10 with respect to a direction of gravity g.

The nozzle holder 6 has apertures 13, 14 through which the primary air can flow from an environment U of the gas burner 2 to the gas nozzles 9, 10. This means that the gas nozzles 9, 10 are not completely surrounded by the nozzle holder 6. Herein, the primary air is supplied to the gas nozzles 9, 10 from below the cooktop plate 3. The nozzle holder 6 furthermore comprises a plate-shaped attachment section 15, which rests on the underside of the cooktop plate 3. The attachment section 15 can have accommodating sections 16, 17, wherein a first accommodating section 16 accommodates a thermoelement 18 for flame monitoring and a second accommodating section 17 accommodates an ignition element 19 for igniting the gas burner 2. A sealing plate 20 can be arranged on the attachment section 15. The sealing plate 20 can be arranged between the attachment section 15 and the cooktop plate.

The burner housing 5 furthermore comprises a burner lower part 21, which is arranged at least partially above the cooktop plate 3. The cooktop plate 3 in particular can be arranged between the burner lower part 21 and the nozzle holder 6 and in particular firmly clamped between them. The burner lower part 21 comprises a mixing chamber element 22, which is substantially assembled rotationally symmetrically to the central axis M2. The mixing chamber element 22 comprises a cylindrical first base section 23 in which a first mixing chamber 24 of the gas burner 2 is assembled rotationally symmetrically to the central axis M2 is provided. The first mixing chamber 24 is positioned with a lower edge 25 above the first gas nozzle 9 with respect to the direction of gravity g. This means that the first gas nozzle 9 is arranged completely outside the first mixing chamber 24. The first gas nozzle 9 is configured to inject combustion gas into the first mixing chamber 24 thus causing primary air to be drawn past the side of the first gas nozzle 9 into the first mixing chamber 24 where it is mixed with the combustion gas.

The mixing chamber element 22 furthermore comprises a second similarly cylindrical base section 26, which is arranged off-center with respect to the central axis M2 and next to the first base section 23. A second mixing chamber 27 of the gas burner 2 is provided in the second base section 26. The second mixing chamber 27 is arranged completely within the second base section 26. A lower edge 28 of the second mixing chamber 27 is arranged above the second gas nozzle 10 with respect to the direction of gravity g. This means that the second gas nozzle 10 is arranged completely outside the second mixing chamber 27. The second gas nozzle 10 is configured to inject combustion gas into the second mixing chamber 27, wherein, on the injection of the combustion gas into the second mixing chamber 27, primary air is drawn past the second gas nozzle 10 into the second mixing chamber 27 where it is mixed with the combustion gas.

The mixing chamber element 22 is at least partially accommodated in the nozzle holder 6. The mixing chamber element 22 furthermore has a disk-shaped circumferential edge section 29. Furthermore, the mixing chamber element 22 can have a first accommodating section 30 to accommodate the thermoelement 18 and a second accommodating section 31 to accommodate the ignition element 19. Furthermore, a stepped bore 32, in which a screw 33, in particular a cheese head screw, is provided for screwing the mixing chamber element 22 to the nozzle holder 6, is provided in the mixing chamber element 22.

The burner lower part 21 furthermore comprises an intermediate element 34. The intermediate element 34 is embodied rotationally symmetrically to the central axis M2 and has a first lateral recess 35 for the thermoelement 18 and a second lateral recess 36 for the ignition element 19. The intermediate element 34 comprises a cylindrical base section 37 embodied rotationally symmetrically to the central axis M2. A part of the first mixing chamber 24 is embodied in the base section 37. This means that the first mixing chamber 24 extends from the mixing chamber element 22 into the intermediate element 34. The second mixing chamber 27 does not extend into the intermediate element 34.

Around the circumference of the base section 37, an annular edge section 38 is provided which is interrupted by the opposing recesses 35, 36. The base section 37 is connected to the edge section 38 in one piece by means of a frustoconical first section 39 and a disk-shaped second section 40. The edge section 38 is provided with a plurality of connecting channels 41 which are only indicated by a reference numeral in FIGS. 3 and 4. The connecting channels 41 can also be provided in the second section 40. The connecting channels 41 are the apertures that breach the intermediate element 34. For example, the connecting channels 41 can be embodied as bores. The number of connecting channels 41 is optional. The connecting channels 41 are preferably arranged uniformly distributed over a circumference of the intermediate element 34.

The burner housing 5 furthermore comprises a burner cover 42. The burner cover 42 is placed on top of the burner lower part 21 and in particular on the intermediate element 34 and can be lifted off this. The burner cover 42 has a base section 43 which is embodied as disk-shaped and rotationally symmetrically to the central axis M2. An annular circumferential bearing section 44 extends from the underside of the base section 43 and lies on the intermediate element 34. The bearing section 44 is provided with a plurality of mixture-outlet openings 45 only one of which is given a reference numeral in FIG. 4. When the gas burner 2 is in operation, a combustion-gas/primary-air mixture exits the mixture-outlet openings 45. Therefore, the mixture-outlet openings 45 combustion gas/primary air mixture-outlet openings can also be referred to as gas-mixture-outlet openings or gas-outlet openings. In the present case, a "gas mixture" or "mixture" should be understood to mean a combustible mixture of combustion gas and primary air. The number of mixture-outlet openings 45 is optional. The mixture-outlet openings 45 are preferably uniformly distributed about a circumference of the bearing section 44. The mixture-outlet openings 45 can be embodied as bores, apertures or, as shown in FIG. 4, as slots.

As FIG. 5 shows, a first mixture-distribution chamber 46 into which the first mixing chamber 24 opens is provided between the intermediate element 34 and the burner cover 42. This means that the first mixing chamber 24 is in direct fluidic connection with the first mixture-distribution chamber 46. The first mixture-distribution chamber 46 is configured to distribute the combustion-gas/primary-air mixture generated in the first mixing chamber 24 uniformly between the mixture-outlet openings 45. The first mixture-distribution chamber 46 can also be configured to mix the combustion gas/primary air mixture further. The first mixture-distribution chamber 46 can also be referred to as a first combustion-gas/primary-air-mixture-distribution chamber or first-gas-mixture-distribution chamber. The first mixture-distribution chamber 46 surrounds the first mixing chamber 24.

A second mixture-distribution chamber 47 is provided below the first mixture-distribution chamber 46 is with respect to the direction of gravity g. The second mixture-distribution chamber 47 is provided between the intermediate element 34 and the mixing chamber element 22. The second mixing chamber 27 opens into the second mixture-distribution chamber 47. This means that the second mixing chamber 27 is in direct fluidic connection with the second mixture-distribution chamber 47. The second mixture-distribution chamber 47 is configured to distribute the combustion-gas/primary-air mixture generated in the second mixing chamber 27 uniformly between the connecting channels 41. The second mixture-distribution chamber 47 can also be configured to mix the combustion-gas/primary-air mixture further. The second mixture-distribution chamber 47 can also be referred to as a second combustion-gas/primary-air-mixture-distribution chamber or second gas-mixture-distribution chamber.

The first mixture-distribution chamber 46 is structurally separate from the second mixture-distribution chamber 47 by means the intermediate element 34. The second mixture-distribution chamber 47 does not have its own mixture-outlet openings 45. The second mixture-distribution chamber 47 is in fluidic connection with the mixture-outlet openings 45 of the first mixture-distribution chamber 46 via the connecting channels 41 such that the combustion-gas/primary-air mixture formed in the second mixing chamber 27 can flow via the second mixture-distribution chamber 47 and the connecting channels 41 to the mixture-outlet openings 45 assigned to the first mixture-distribution chamber 46 where it exits the gas burner 2 for the purpose of flame formation. Preferably, a connecting channel 41 is assigned to each mixture-outlet opening 45.

FIGS. 6 to 9 show an alternative embodiment of a gas burner 2 in different sectional views. The functionality of the gas burner 2 in FIGS. 6 to 9 corresponds to the functionality of the gas burner in FIGS. 2 to 5. Therefore, the functionality of the gas burner 2 is explained with reference to FIGS. 6 to 9 which are referred to simultaneously in the following.

The gas burner 2 in FIGS. 6 to 9 only differs from the gas burner 2 in FIGS. 2 to 5 in an alternative embodiment of the intermediate element 34 and of the nozzle holder 6. With this embodiment of the nozzle holder 6, the first gas nozzle 9 and the second gas nozzle 10 are positioned, not at different heights, but at the same height with respect to the direction of gravity g. The intermediate element 34 of the gas burner 2 in FIGS. 6 to 9 substantially differs from the intermediate element 34 of the gas burner 2 in FIGS. 2 to 5 in that this is arranged inside the mixing chamber element 22 and that the connecting channels 41 are embodied not as bores, but as lateral grooves or slots in the edge section 38 of the intermediate element 34. As a result, the intermediate element 34 is less expensive and simpler to produce.

Figure 6:
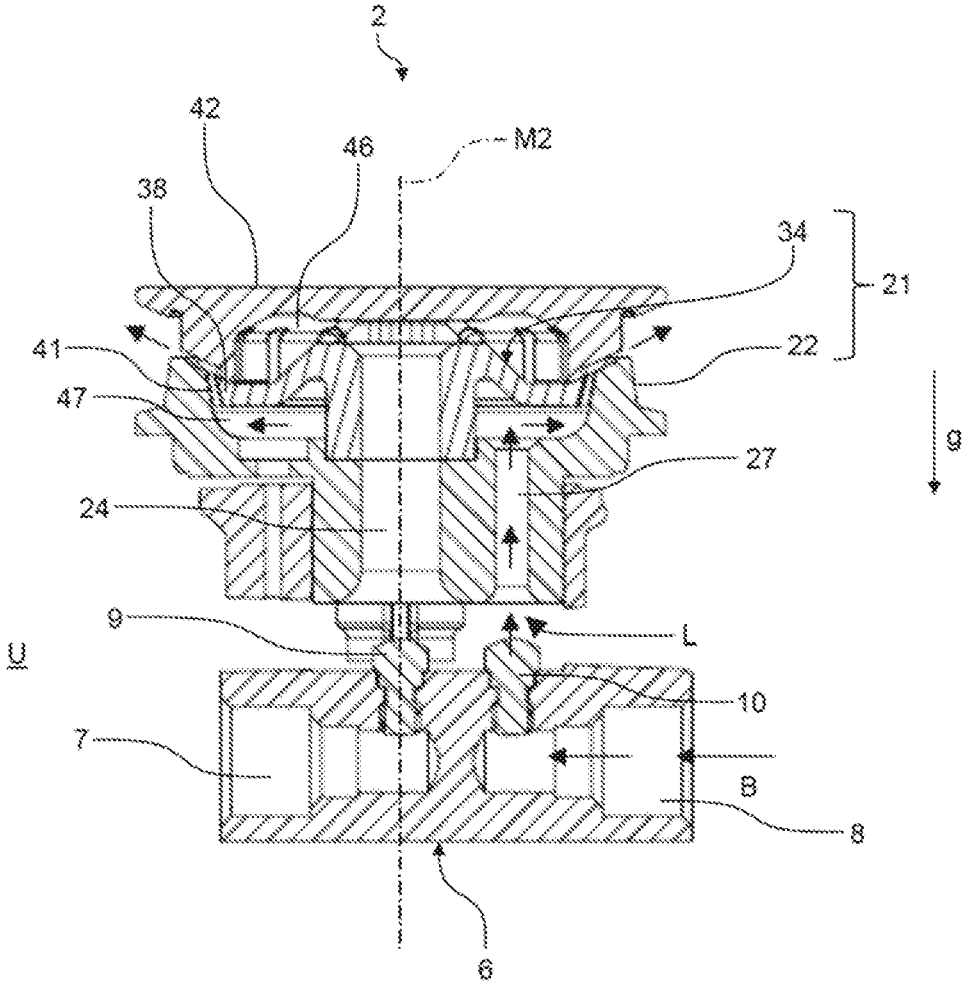
FIG. 6 shows a schematic sectional view of a further embodiment of a gas burner for the household cooking appliance in FIG. 1.
Figure 7:
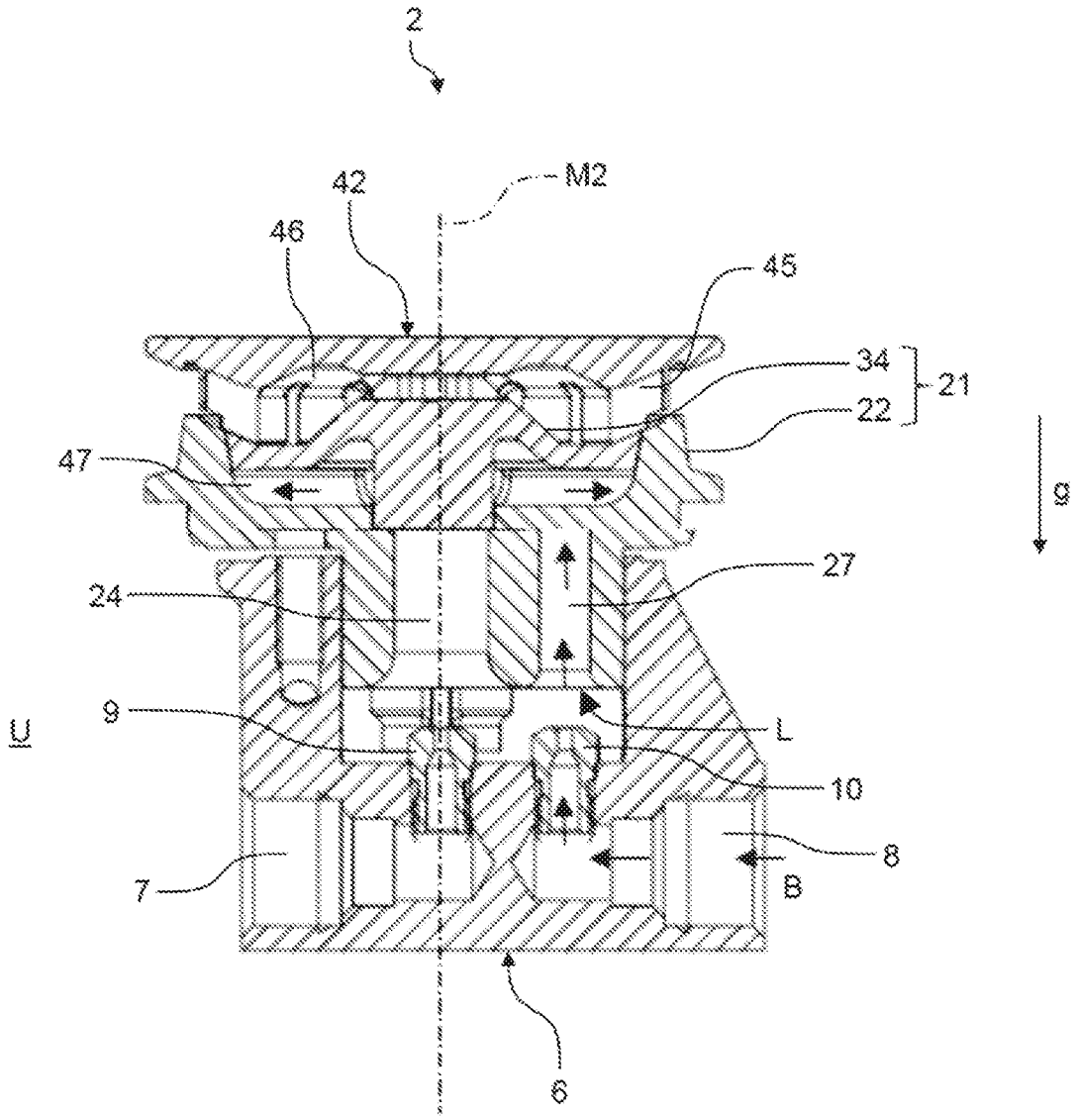
FIG. 7 shows a further schematic sectional view of the gas burner in FIG. 6.

FIGS. 6 and 7 show the gas burner 2 in a minimum-flame mode. Minimum-flame mode can also be referred to as simmer mode. In minimum-flame mode, the gas burner 2 can be operated at very low power. In minimum-flame mode, the power of the gas burner 2 can be adjusted by means of the gas-control valve 4. In minimum-flame mode, combustion gas B is only supplied to the gas burner 2 via the second gas-supply line 8. The combustion gas B is injected into the second mixing chamber 27 via the second gas nozzle 10. Herein, a Venturi effect causes primary air L to be drawn in from the environment U past the second gas nozzle 10 into the second mixing chamber 27 where it is mixed with the combustion gas B. The mixing of the combustion gas B with the primary air L may not yet be fully completed in the second mixing chamber 27. The at least premixed combustion-gas/primary-air mixture flows from the second mixing chamber 27 into the second mixture-distribution chamber 47, wherein the combustion gas B and the primary air L can be mixed further. This results in particularly homogeneous mixing of the combustion gas B with the primary air L.

The combustion-gas/primary-air mixture flows from the second mixture-distribution chamber 47 via the connecting channels 41 to the mixture-outlet openings 45 of the first mixture-distribution chamber 46, wherein the combustion-gas/primary-air mixture exits the gas burner 2 exits and is combusted for the purpose of flame formation. The flow paths of the combustion gas B and the combustion-gas/primary-air mixture are depicted by arrows in FIGS. 6 and 7.

Figure 8:
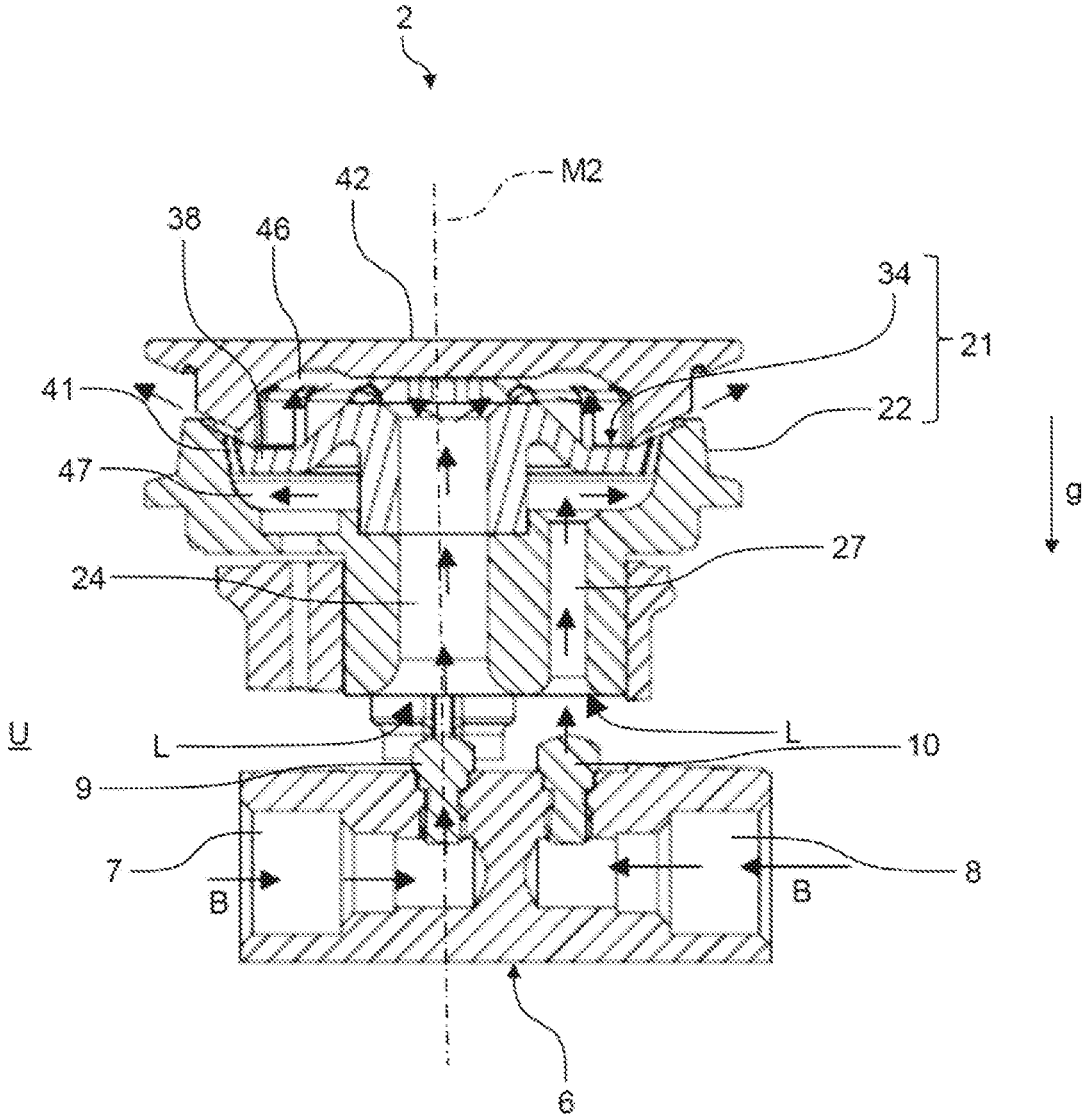
FIG. 8 shows a further schematic sectional view of the gas burner in FIG. 6.
Figure 9:
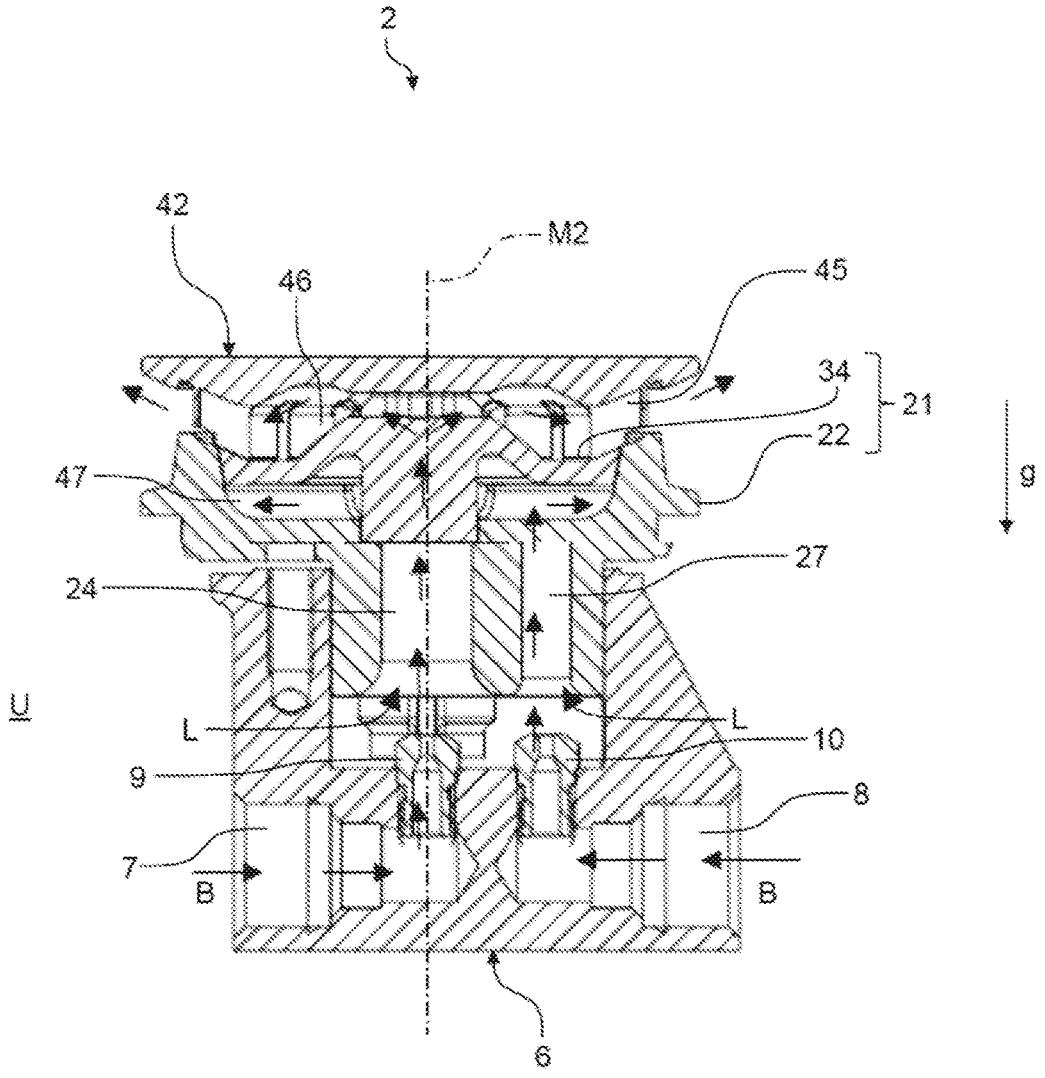
FIG. 9 shows a further schematic sectional view of the gas burner in FIG. 6.

FIGS. 8 and 9 show the gas burner 2 in maximum-flame mode. In maximum-flame mode, the power of the gas burner 2 can be adjusted by means of the gas-control valve 4. In both minimum-flame mode and maximum-flame mode, the power of the gas burner 2 can be adjusted with only one gas-control valve 4. In maximum-flame mode, combustion gas B is supplied to the gas burner 2 via both the first gas-supply line 7 and the second gas-supply line 8. As described above, the combustion gas B is injected into the second mixing chamber 27 by the second gas nozzle 10 where it is mixed with the primary air L drawn in at the side. The combustion-gas/primary-air mixture flows from the second mixing chamber 27 into the second mixture-distribution chamber 47 and there via the connecting channels 41 directly to the mixture-outlet openings 45 without flowing into the first mixture-distribution chamber 46.

The first gas nozzle 9 simultaneously injects combustion gas B into the first mixing chamber 24 and as a result primary air L is drawn in at the side past the first gas nozzle 9 into the first mixing chamber 24 where it is mixed with the combustion gas B. The premixed combustion-gas/primary-air mixture is supplied from the first mixing chamber 24 to the first mixture-distribution chamber 46 and uniformly distributed between the mixture-outlet openings 45, wherein the combustion-gas/primary-air mixture mixed in the first mixing chamber 24 and the combustion-gas/primary-air mixture mixed in the second mixing chamber 27 flow out of the mixture-outlet openings 45 simultaneously. In maximum-flame mode, it is also possible to switch off the supply of combustion gas B to the second gas nozzle 10.

The fact that the gas burner 2 has two mixing chambers 24, 27 also enables the gas burner 2 to be operated at a very low burning power together with high flame stability. This means that, even in minimum-flame mode, the gas burner 2 operates efficiently and does not go out. For example, the gas burner 2 can be operated in the aforementioned simmer mode. The fact that only one common row of mixture-outlet openings 45 is provided that for both mixture-distribution chambers 46, 47 means that a simpler and more aesthetic design of the gas burner 2 can be achieved compared to gas burners with two rows of such mixture-outlet openings. The row of mixture-outlet openings 45 can be referred to as a burner ring. Furthermore, fewer parts are required compared to known gas burners. The gas burner is also very simple to clean. The costs of producing the gas burner 2 and during operation of the gas burner 2 at very lower burning power can be significantly reduced compared to known gas burners.

The invention claimed is:

1. A gas burner for a household cooking appliance, said gas burner comprising:

a first mixture-distribution chamber having a plurality of mixture-outlet openings;

a second mixture-distribution chamber separate from the first mixture-distribution chamber, said second mixture-distribution chamber being fluidically connected to the mixture-outlet openings of the first mixture-distribution chamber such that, when the gas burner is in operation, a combustion-gas/primary-air mixture is conducted out from the first mixture-distribution chamber and a combustion-gas/primary-air mixture is conducted out from the second mixture-distribution chamber via the mixture-outlet openings for flame formation, and a connecting channel fluidically connecting the second mixture-distribution chamber to the mixture outlet openings of the first mixture-distribution chamber.

2. The gas burner of claim 1, wherein the first mixture-distribution chamber is arranged above the second mixture-distribution chamber with respect to a direction of gravity.

3. The gas burner of claim 1, further comprising:

a first mixing chamber for mixing combustion gas with primary air, said first mixing chamber being in direct fluidic connection with the first mixture-distribution chamber; and a second mixing chamber separate from the first mixing chamber for mixing combustion gas with primary air, said second mixing chamber being in direct fluidic connection with the second mixture-distribution chamber.

4. The gas burner of claim 3, wherein the first mixing chamber has a volume which is greater than a volume of the second mixing chamber.

5. The gas burner of claim 3, further comprising:

a first gas nozzle for injecting combustion gas into the first mixing chamber, and a second gas nozzle for injecting combustion gas into the second mixing chamber.

6. The gas burner of claim 1, further comprising a burner housing, and an intermediate element, which is part of the burner housing and which separates the first mixture-distribution chamber from the second mixture-distribution chamber.

7. The gas burner of claim 6, wherein the connecting channel is embodied as a bore in the intermediate element or as a groove on an edge section of the intermediate element.

8. The gas burner of claim 3, further comprising a burner housing and an intermediate element, which is part of the burner housing and which separates the first mixture-distribution chamber from the second mixture-distribution chamber, said first mixing chamber being at least partially arranged in the intermediate element.

9. The gas burner of claim 8, wherein the burner housing has a nozzle holder, a burner lower part comprising the intermediate element and a mixing chamber element, and a burner cover placed on the burner lower part.

10. The gas burner of claim 9, wherein the first mixing chamber is arranged at least partially in the mixing chamber element and the second mixing chamber is arranged completely in the mixing chamber element.

11. The gas burner of claim 9, wherein the first mixture-distribution chamber is provided between the intermediate element and the burner cover and/or the second mixture-distribution chamber is provided between the mixing chamber element and the intermediate element.

12. The gas burner of claim 9, wherein the mixture-outlet openings are provided on the burner cover.

13. The gas burner of claim 1, further comprising a plurality of said connecting channel.

14. A household cooking appliance, comprising a gas burner said gas burner comprising a first mixture-distribution chamber having a plurality of mixture-outlet openings, and a second mixture-distribution chamber separate from the first mixture-distribution chamber, said second mixture-distribution chamber being fluidically connected to the mixture-outlet openings of the first mixture-distribution chamber via a connecting channel fluidically connecting the second mixture-distribution chamber to the mixture-outlet openings of the first mixture-distribution chamber such that, when the gas burner is in operation, a combustion-gas/primary-air mixture is conducted out from the first mixture-distribution chamber and a combustion-gas/primary-air mixture is conducted out from the second mixture-distribution chamber via the mixture-outlet openings for flame formation.

15. The household cooking appliance of claim 14, constructed in the form of a gas stove.

16. The household cooking appliance of claim 14, wherein the first mixture-distribution chamber is arranged above the second mixture-distribution chamber with respect to a direction of gravity.

17. The household cooking appliance of claim 14, wherein the gas burner includes a first mixing chamber for mixing combustion gas with primary air, said first mixing chamber being in direct fluidic connection with the first mixture-distribution chamber, and a second mixing chamber separate from the first mixing chamber for mixing combustion gas with primary air, said second mixing chamber being in direct fluidic connection with the second mixture-distribution chamber.

18. The household cooking appliance of claim 17, wherein the first mixing chamber has a volume which is greater than a volume of the second mixing chamber.

19. The household cooking appliance of claim 17, wherein the gas burner includes a first gas nozzle for injecting combustion gas into the first mixing chamber, and a second gas nozzle for injecting combustion gas into the second mixing chamber.

20. The household cooking appliance of claim 14, wherein the gas burner includes a burner housing and an intermediate element, which is part of the burner housing and which separates the first mixture-distribution chamber from the second mixture-distribution chamber.

21. The household cooking appliance of claim 6, wherein the connecting channel is embodied as a bore in the intermediate element or as a groove on an edge section of the intermediate element.

22. The household cooking appliance of claim 17, wherein the gas burner includes a burner housing, and an intermediate element, which is part of the burner housing and which separates the first mixture-distribution chamber from the second mixture-distribution chamber, said first mixing chamber being at least partially arranged in the intermediate element.

23. The household cooking appliance of claim 22, wherein the burner housing has a nozzle holder, a burner lower part comprising the intermediate element and a mixing chamber element, and a burner cover placed on the burner lower part.

24. The household cooking appliance of claim 23, wherein the first mixing chamber is arranged at least partially in the mixing chamber element and the second mixing chamber is arranged completely in the mixing chamber element.

25. The household cooking appliance of claim 23, wherein the first mixture-distribution chamber is provided between the intermediate element and the burner cover and/or the second mixture-distribution chamber is provided between the mixing chamber element and the intermediate element.

26. The household cooking appliance of claim 23, wherein the mixture-outlet openings are provided on the burner cover.

27. The household cooking appliance of claim 14, wherein the gas burner includes a plurality of said connecting channel.

* * * * *